US005896589A

United States Patent [19]

Chou

[11] Patent Number: 5,896,589

[45] Date of Patent: Apr. 27, 1999

[54] SWIMMING GOGGLE FRAME WITH DEFORMATION PREVENTION

[76] Inventor: Terry Chou, No. 12, Hsin Ho Herng Road, Tainan City, Taiwan

[21] Appl. No.: 09/090,804

[22] Filed: Jun. 4, 1998

[51] Int. Cl.[6] ..... A61F 9/02

[52] U.S. Cl. ..... 2/428; 2/441; 2/452

[58] Field of Search ..... 2/428, 430, 429, 2/445, 452, 446, 440, 441, 443, 426, 431; 351/43

[56] References Cited

U.S. PATENT DOCUMENTS

| | | | |
|---|---|---|---|
| 5,313,671 | 5/1994 | Flory | 2/428 |
| 5,564,132 | 10/1996 | Kuo | 2/441 X |
| 5,706,526 | 1/1998 | Huang | 2/428 |
| 5,711,036 | 1/1998 | Kita et al. | 2/426 X |
| 5,802,621 | 9/1998 | Chou | 2/430 |

*Primary Examiner*—Peter Nerbun
*Attorney, Agent, or Firm*—Rosenberg, Klein & Bilker

[57] ABSTRACT

A pair of swimming goggles includes two rigid transparent lenses, a frame, and a strap. Each lens includes an extension extending outwardly and having a distal end. Each lens further includes a first flange formed thereon. The frame includes two rings interconnected by a bridge. Each ring includes an annular engaging section for engaging with the first flange of an associated lens. Each ring further includes a second flange formed on an inner side thereof to provide a close contact with an eye socket of a user. The annular engaging section of each ring includes an aperture defined therein through which the extension is extended. Each ring further includes a sleeve portion in which a space that is communicated with environment is defined for receiving the distal end of an associated extension. Two ends of the strap are respectively engaged with the distal ends of the extensions of the lenses.

3 Claims, 8 Drawing Sheets

SWIMMING GOGGLE FRAME WITH DEFORMATION PREVENTION

BACKGROUND OF THE INVENTION

1. Field of the Invention

The present invention relates to a frame of a pair of swimming goggles which may prevent from deformation resulting from pulling.

2. Description of the Related Art

FIG. 6 of the drawings illustrates a pair of conventional swimming goggles that includes two rigid transparent lenses 1', two pad members 2', and a strap 4'. Each lens 1' includes a first slot 12' defined in an outer end thereof for engaging with an end 41' of the strap 4' and a second slot 11' for engaging with a bridge member 3'. The bridge member 3' includes a number of ridges 31' formed on an inner side thereof for engaging with a periphery defining the second slot 11' of each lens 1'. Each pad member 2' includes an engaging section 21' formed on an outer side thereof for engaging with a corresponding engaging section 13' of the associated lens 1'. Each pad member 2' further includes a flange 22' formed on an inner side thereof to provide a comfort, close contact with an eye socket of the user and to provide an impermeable effect. However, referring to FIG. 7, the user may be injured if the bridge member 3' is impinged and thus moved toward the face of the user.

FIGS. 8 and 9 illustrate another pair of conventional swimming goggles, in which the two frames 5', the two pad members 6' and the bridge member 7' are integrally formed of plastic material, and each transparent rigid lens 8' is enclosed by an enclosing section 51' of an associated frame 5'. In addition, each frame 5' includes a connecting section 52' formed on an outer side thereof through which an end of the strap 9 extends. However, as shown in FIG. 9, a gap "a" may be generated when the strap 9' is pulled outwardly. As a result, leakage may occur.

The present invention is intended to provide a frame of a pair of swimming goggles for preventing from leakage resulting from pulling of the strap.

SUMMARY OF THE INVENTION

The present invention relates to a pair of swimming goggles which comprises:

two rigid transparent lenses, each lens including an extension extending outwardly and having a distal end, each lens further including a first flange formed thereon, a frame including two rings interconnected by a bridge, each ring including an annular engaging section for engaging with the first flange of an associated lens, each ring further including a second flange formed on an inner side thereof to provide a close contact with an eye socket of a user, the annular engaging section of each ring including an aperture defined therein through which the extension is extended, each ring further including a sleeve portion in which a space that is communicated with environment is defined for receiving the distal end of an associated extension, and a strap having two ends respectively engaged with the distal ends of the extensions of the lenses.

The distal end of the extension may include a closed ring through which the strap is extended. Alternatively, the distal end of the extension includes a hooked end having a compartment with a passage, wherein the passage has a width slightly smaller than a thickness of the strap.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
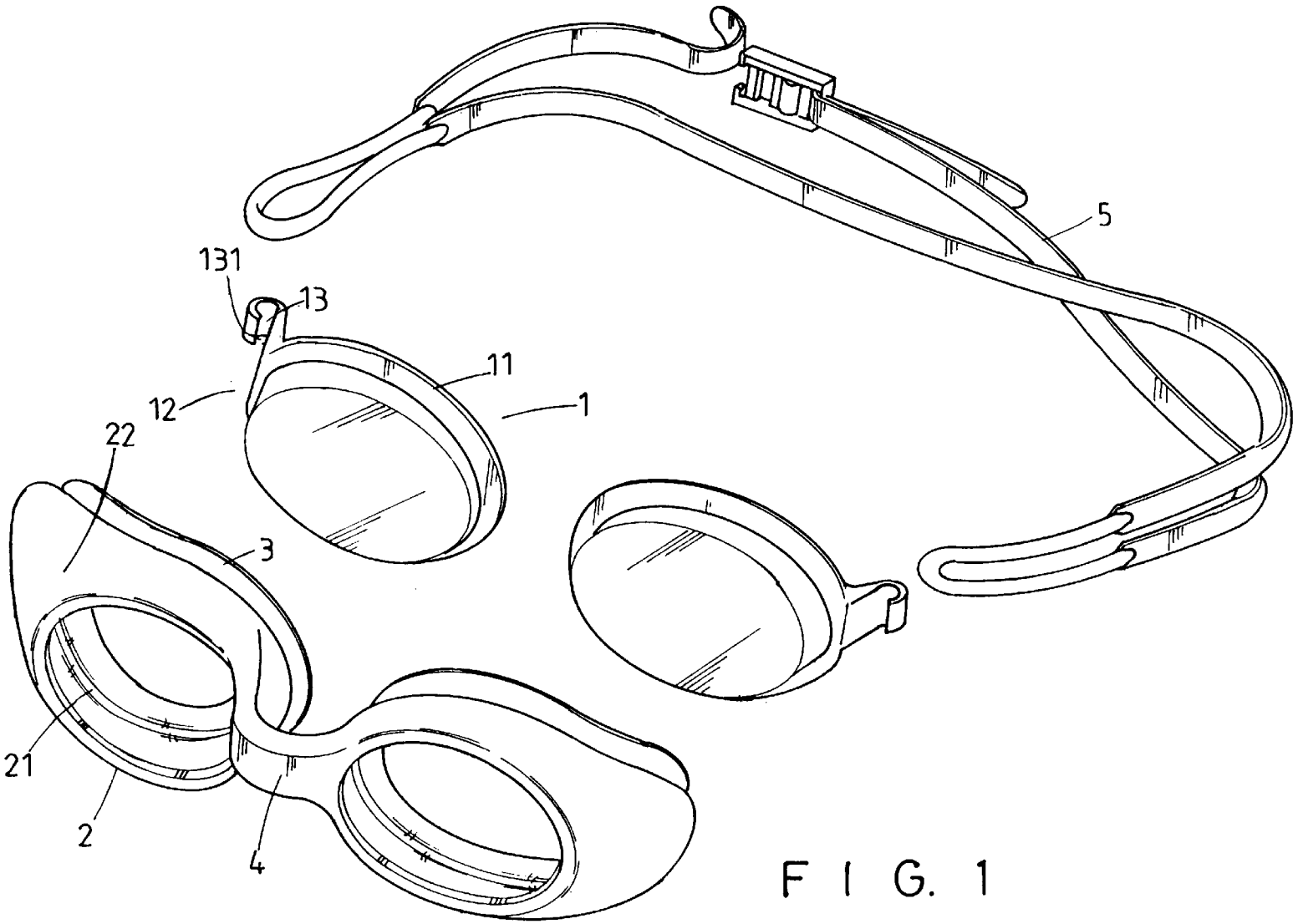
FIG. 1 is an exploded perspective view of a pair of swimming goggles in accordance with the present invention.
Figure 2:
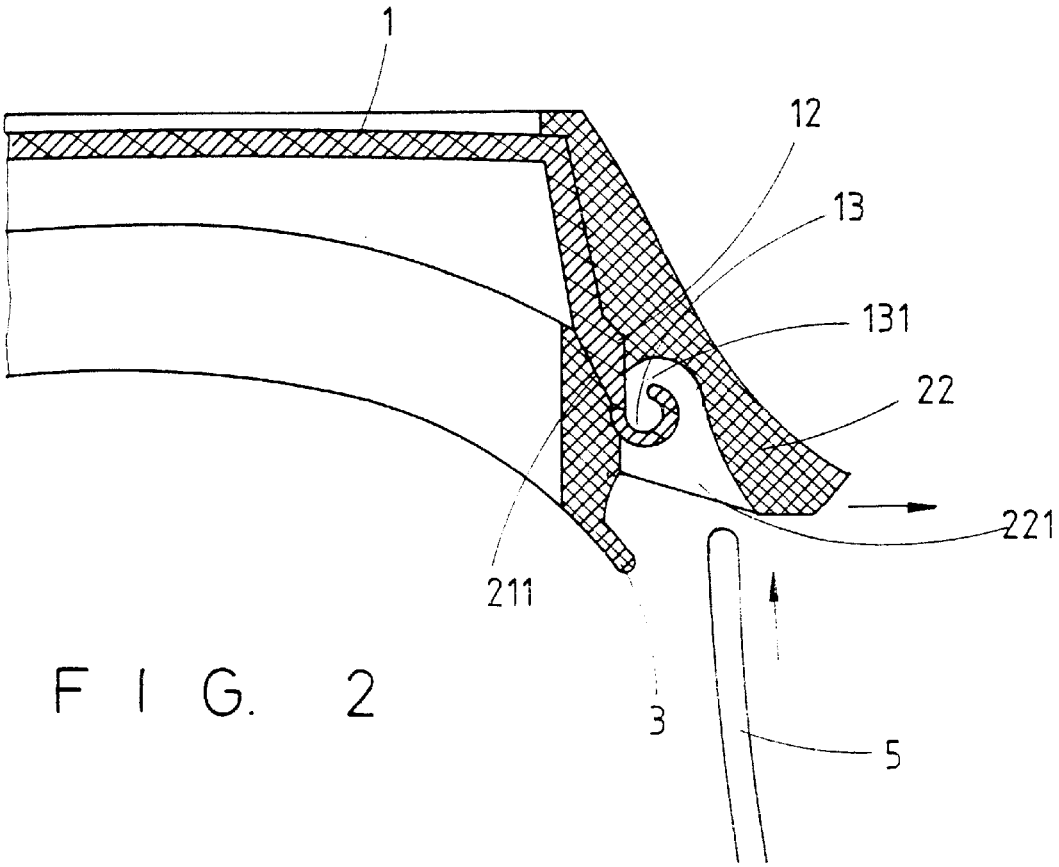
FIG. 2 is a partial sectional view illustrating assembly of the swimming goggles in FIG. 1.
Figure 3:
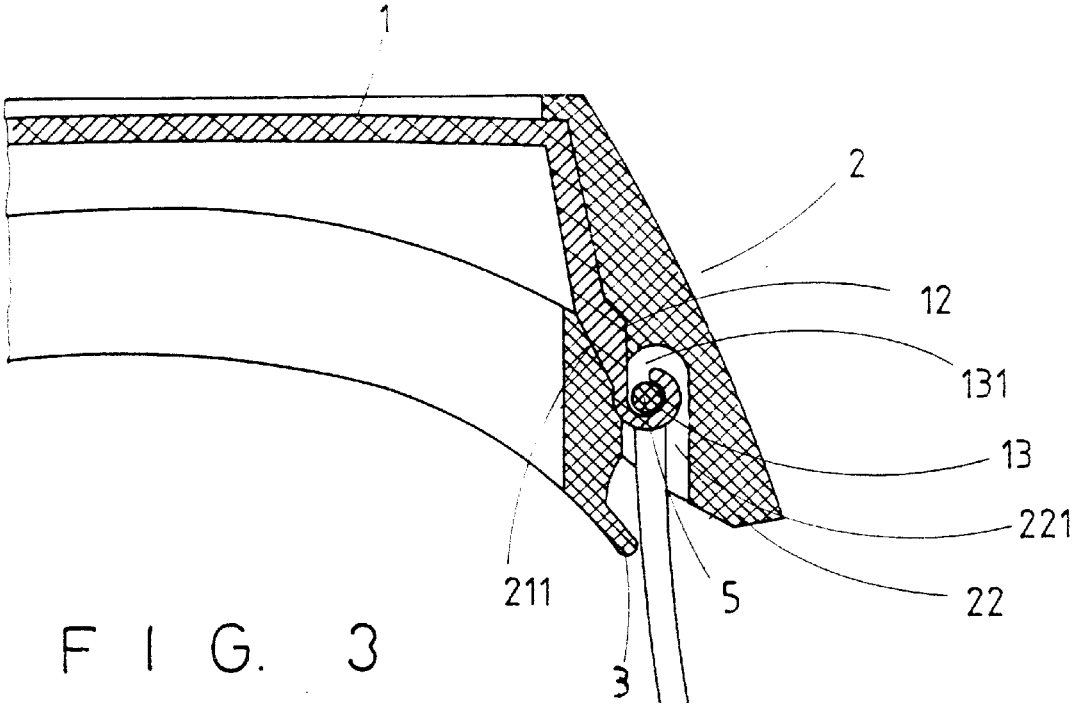
FIG. 3 is a view similar to FIG. 2, wherein the strap has been mounted.
Figure 4:
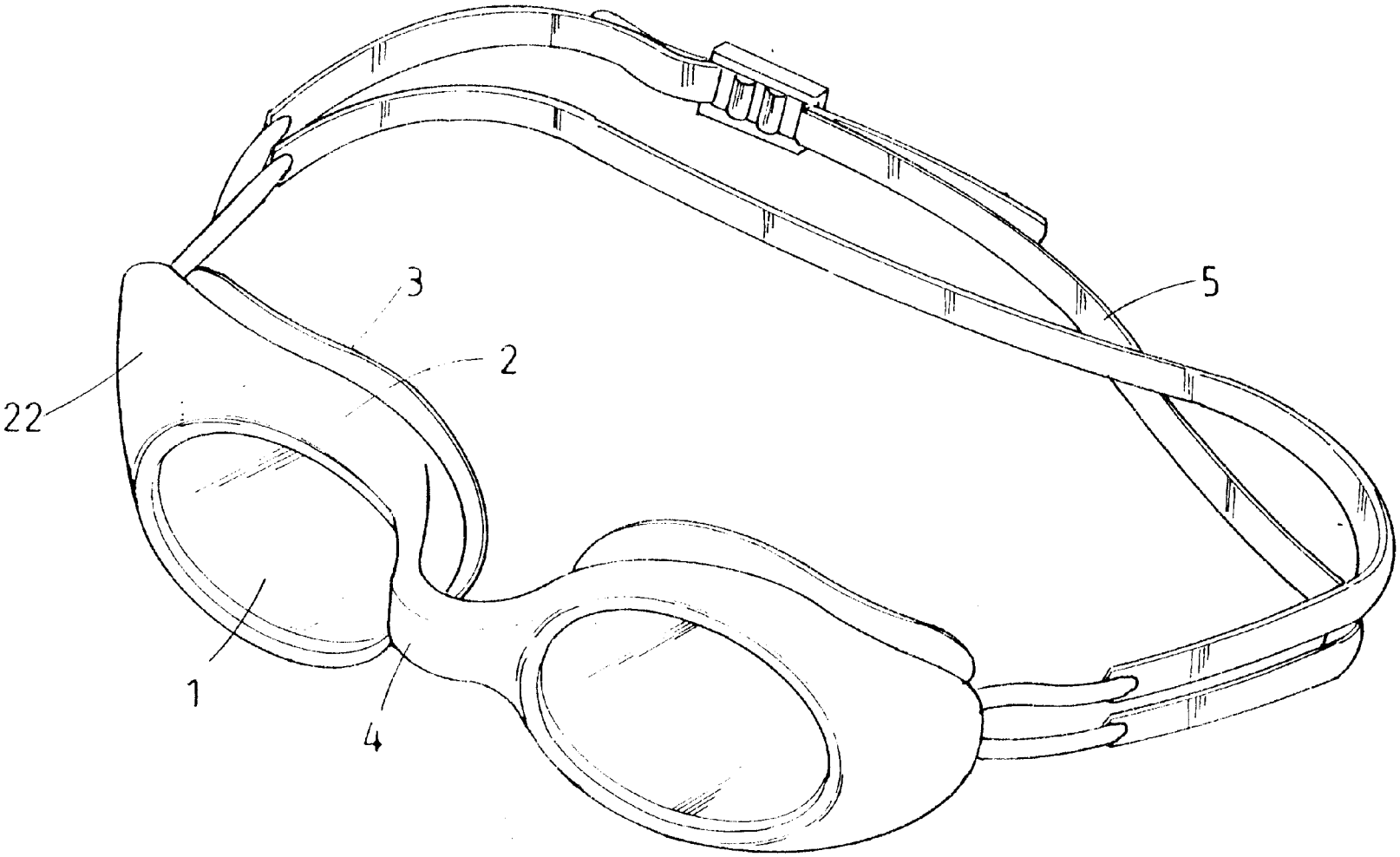
FIG. 4 is a perspective view of the pair of swimming goggles in FIG. 1.

Referring to FIGS. 1 to 5 and initially to FIGS. 1, 2, and 4, a pair of swimming goggles in accordance with the present invention generally includes two rigid transparent lenses 1, a strap 5, and a frame including two rings 2 interconnected by a bridge 4. The frame is preferably integrally formed of plastic material. Each lens 1 includes a flange 11 formed on an inner side thereof, which will be described later. Each lens 1 further includes an extension 12 formed on an outer end thereof, the extension 12 including a hooked end which defines a compartment 13 with a passage 131. An end of the strap 5 can be passed through the passage 131 and thus retained in the compartment 13 as the passage 131 is selected to have a width slightly smaller than a thickness of the strap 5 to allow forcible insertion of the strap 5. Each ring 2 includes an annular engaging section 21 defined in an inner periphery thereof and a flange 3 formed on an inner side thereof to provide a close contact with the eye socket of the user. Referring to FIG. 2, an aperture 211 is defined in the annular engaging section 21 of each ring 2 through which an associated extension 12 is extended. Each ring 2 further includes a sleeve portion 22, wherein a space 221 that is communicated with environment is defined in each sleeve portion 22 for receiving an associated extension 12.

In assembly, the engaging section 21 of each ring 2 is engaged with the flange 11 of the associated lens 1, and the extension 12 of each lens 1 is extended through the aperture 211 of the associated engaging section 21 into the associated space 221, best shown in FIG. 2. Then, the sleeve portion 22 is pulled outwardly (see the arrow on the right side of the sleeve portion 22) to allow insertion of the strap 5 into the space 221 for engagement with the hooked end of the extension 12, best shown in FIG. 3 to accomplish assembly. By such an arrangement, when the strap 5 is pulled, as the lens 1 is rigid, the extension 12 bears the pulling force such that deformation of the frame resulting from the pulling is prevented.

Figure 5:
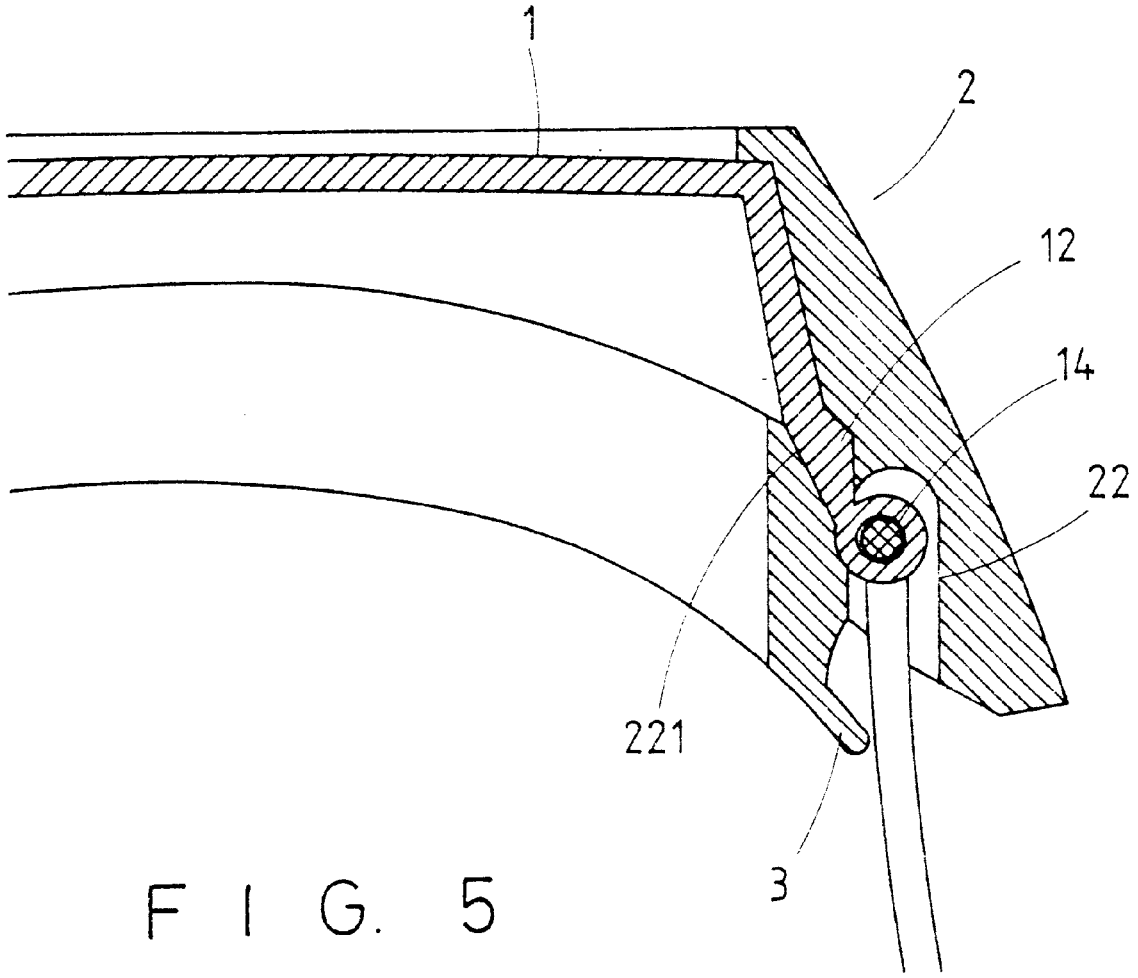
FIG. 5 is a partial sectional view illustrating a modified embodiment of the invention.
Figure 6:
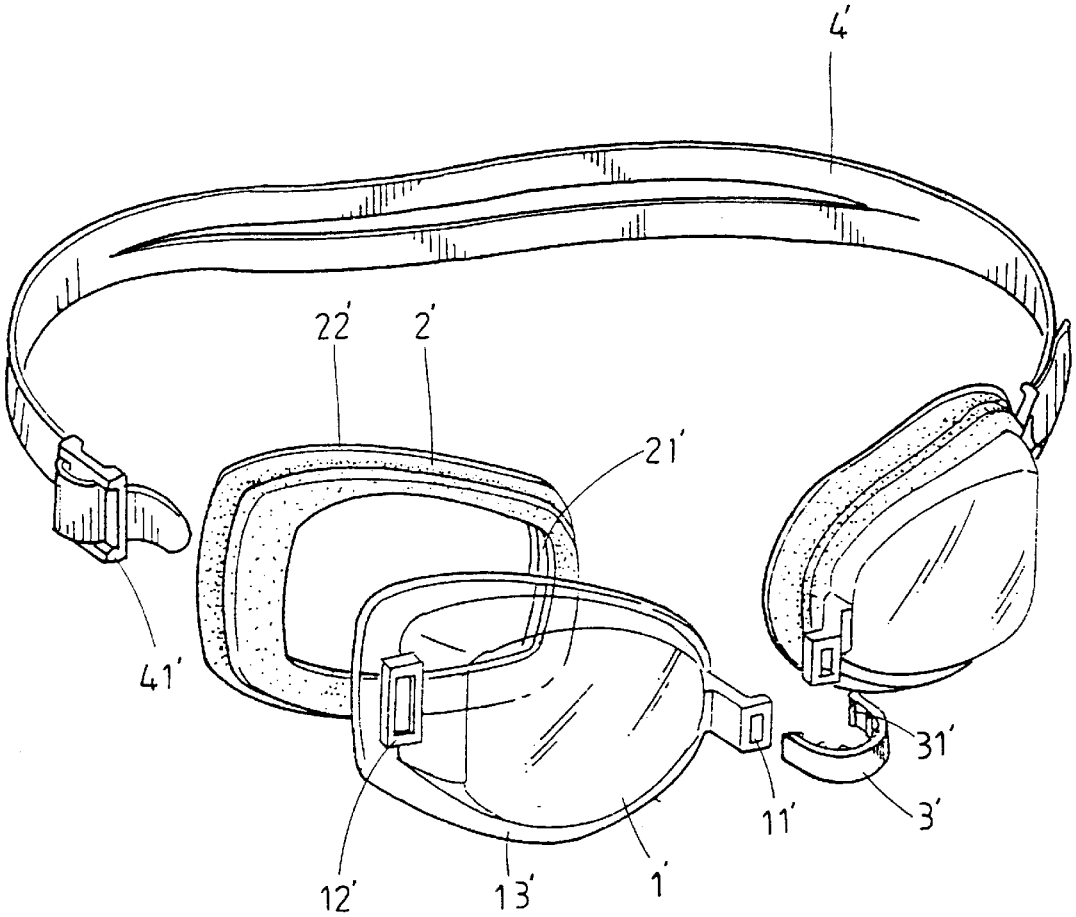
F I G. 6 PRIOR ART
FIG. 6 is an exploded perspective view illustrating a pair of conventional swimming goggles.
Figure 7:
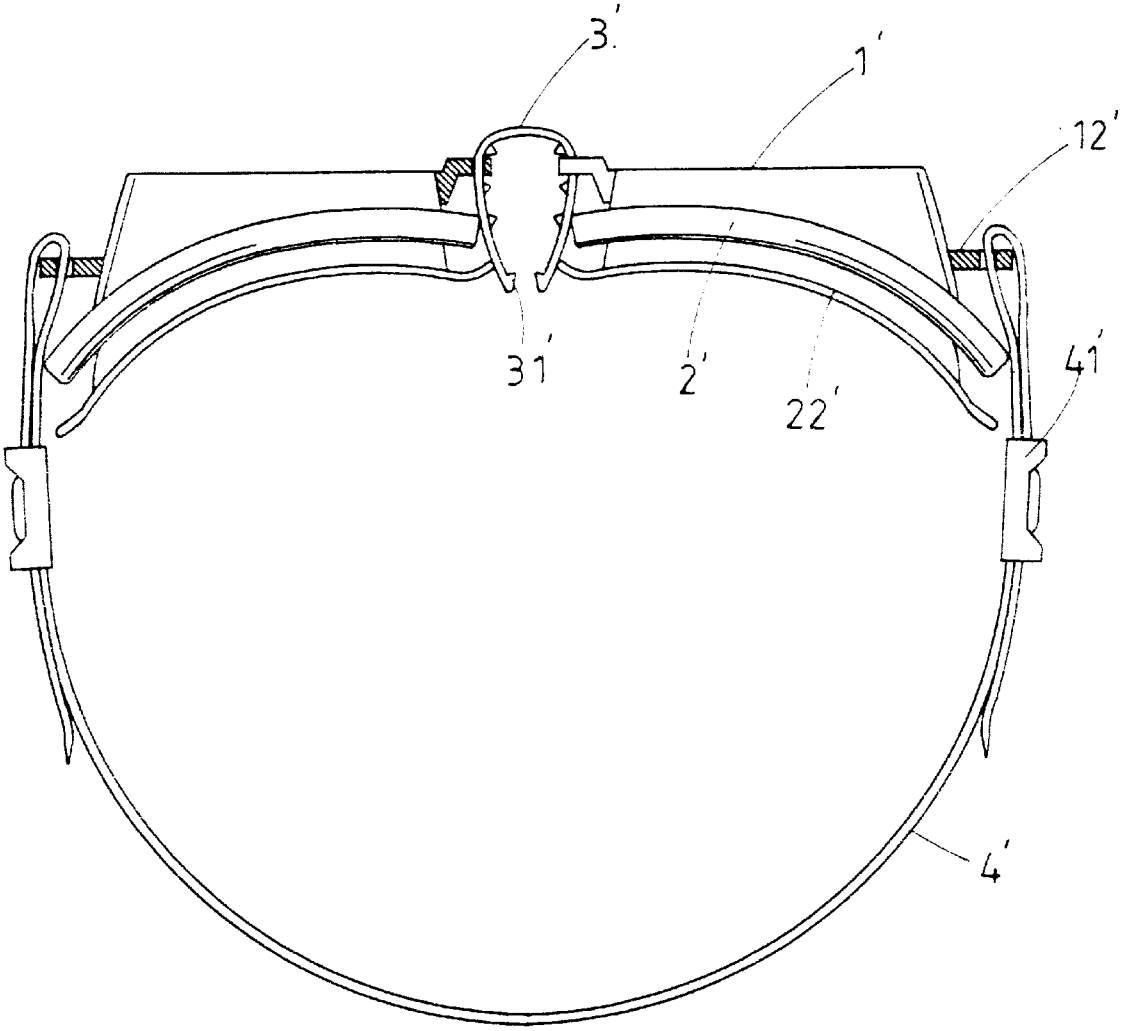
FIG. 7 PRIOR ART
FIG. 7 is a top view of the swimming goggles in FIG. 6.
Figure 8:
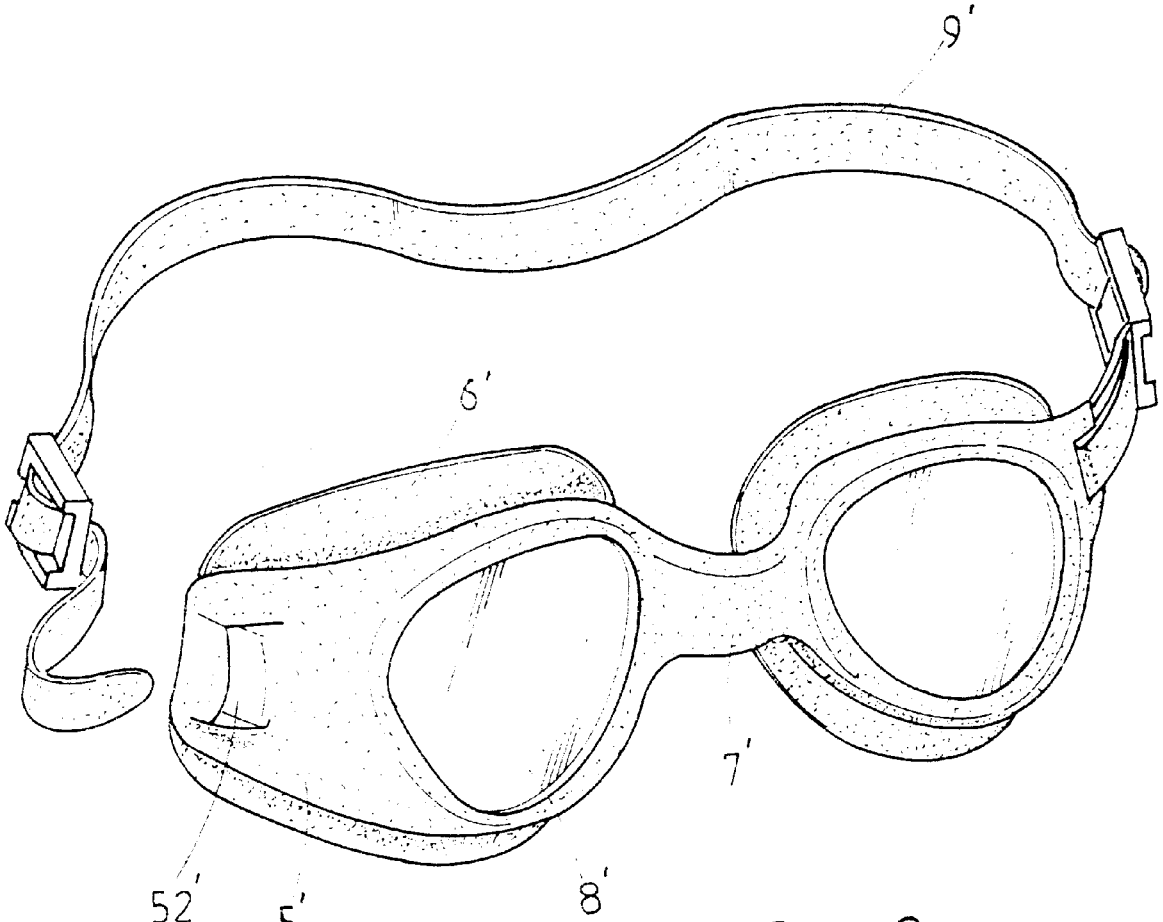
FIG. 8 PRIOR ART
FIG. 8 is a perspective exploded view illustrating another pair of swimming goggles.
Figure 9:
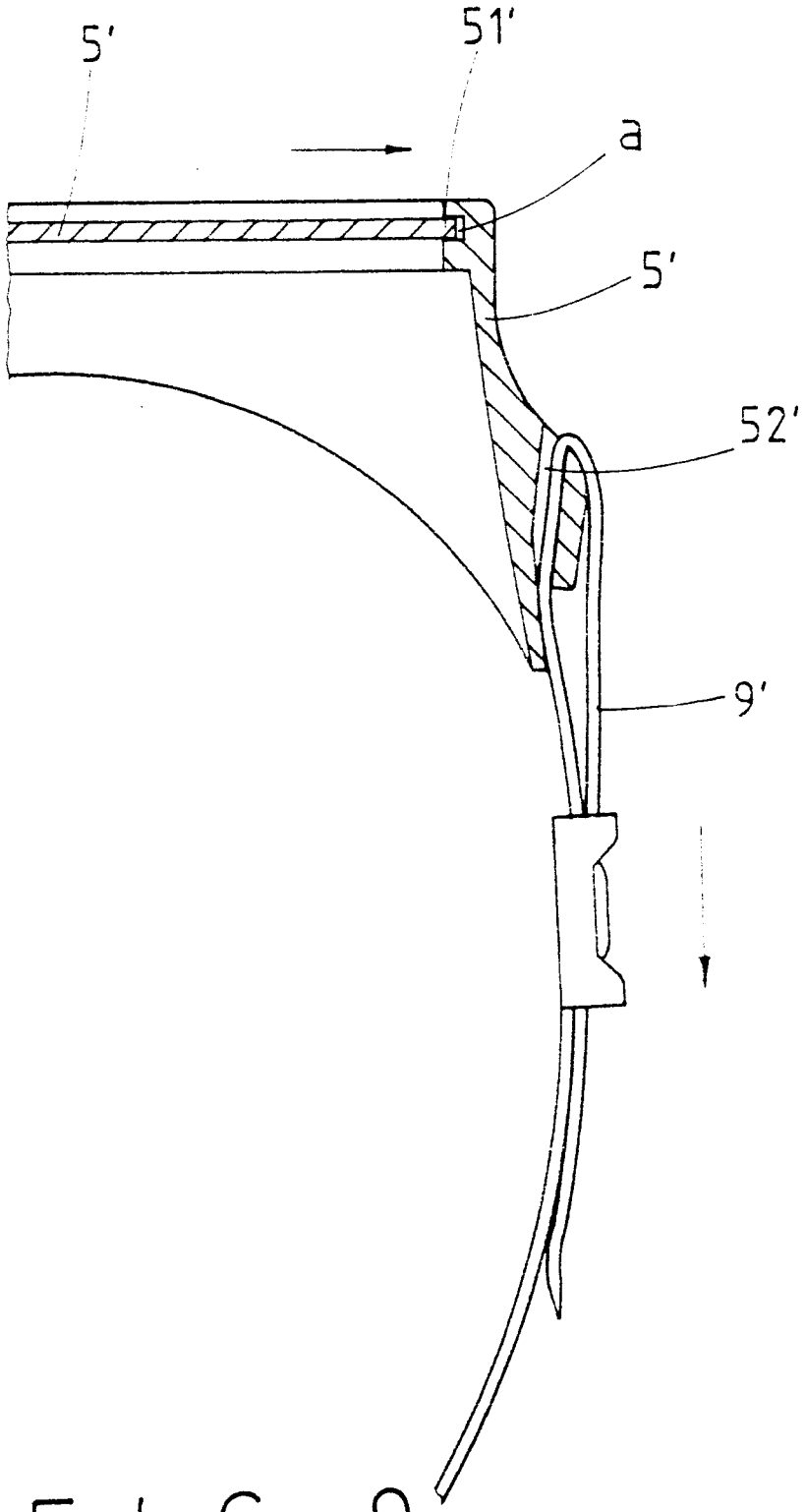
FIG. 9 PRIOR ART
FIG. 9 is a partial sectional view of the swimming goggles in FIG. 8.

FIG. 5 illustrates a modified embodiment of the invention, wherein the hooked end of the extension 12 is replaced by a closed ring 14 through which the strap 5 is extended.

According to the above description, it is appreciated that deformation of the frame of the pair of swimming goggles of the present invention during pulling of the strap is prevented from to thereby assure water-tightness. In addition, the extension 12 for engaging with the strap 5 is hidden in the space 221 and thus provides an advantage in aesthetics.

Although the invention has been explained in relation to its preferred embodiment, it is to be understood that many other possible modifications and variations can be made without departing from the spirit and scope of the invention as hereinafter claimed.

What is claimed is:

1. A pair of swimming goggles, comprising:

two rigid transparent lenses, each said lens including an extension extending outwardly and having a distal end, each said lens further including a first flange formed thereon, a frame including two rings interconnected by a bridge, each said ring including an annular engaging section for engaging with the first flange of an associated said lens, each said ring further including a second flange formed on an inner side thereof adapted to provide a close contact with an eye socket of a user, the annular engaging section of each said ring including an aperture defined therein through which the extension is extended, each said ring further including a sleeve portion in which a space that is communicated with environment is defined for receiving the distal end of an associated said extension, and a strap having two ends respectively engaged with the distal ends of the extensions of the lenses.

2. The pair of swimming goggles according to claim 1, wherein said distal end of said extension includes a closed ring through which the strap is extended.

3. The pair of swimming goggles according to claim 1, wherein said distal end of said extension includes a hooked end having a compartment with a passage, wherein the passage has a width slightly smaller than a thickness of the strap.

* * * * *